United States Patent [19]

Ganz

[11] Patent Number: 4,663,914

[45] Date of Patent: May 12, 1987

[54] WRAPPING MACHINE FOR APPLYING A WEB TO ONE OR MORE ARTICLES TO FORM A PACKAGE

[75] Inventor: Robert H. Ganz, Saddle River, N.J.

[73] Assignee: The Mead Corporation, Dayton, Ohio

[21] Appl. No.: 832,573

[22] Filed: Feb. 24, 1986

[51] Int. Cl.[4] ..... B65B 21/22; B65B 27/04

[52] U.S. Cl. ..... 53/398; 53/48; 53/233; 53/590

[58] Field of Search ..... 53/398, 399, 462, 466, 53/48, 586, 590, 233

[56] References Cited

U.S. PATENT DOCUMENTS

| | | | |
|---|---|---|---|
| Re. 28,535 | 9/1975 | Ganz | 53/398 |
| 2,882,665 | 4/1959 | Cross | 53/233 |
| 3,220,160 | 11/1965 | Roberts | 53/233 |
| 3,516,219 | 6/1970 | Nigrelli et al. | 53/48 |
| 3,866,386 | 2/1975 | Ganz | 53/48 X |
| 3,965,645 | 6/1976 | Ganz | 53/590 X |
| 4,083,163 | 4/1978 | Ganz | 53/48 |
| 4,338,760 | 7/1982 | Kuhn | 53/48 |

*Primary Examiner*—Horace M. Culver

*Attorney, Agent, or Firm*—Charles E. Brown; Charles A. Brown

[57] ABSTRACT

This relates to a wrapping machine of the type wherein a web is automatically wrapped about one or a group of articles to form a package. A continuous web is provided and this web has at regular intervals a series of transversely aligned cutouts. After the web has passed over the article or articles to be wrapped, the web between two adjacent sets of articles is hooked onto a web drawing member of an article transporting conveyor which is moving at a greater rate than the article being wrapped. A simple web pressing mechanism is provided for pressing the web down in front of the web drawing member and holding the web portion in a pressed condition until the advancing web drawing member engages fingers thereof into the cutouts in the web. The web pressing mechanism is carried by an endless conveyor and is either fixed and the web drawing member is tilted by a cam to engage the web or the web pressing mechanism is actuated by a fixed cam so that the operation thereof is simple and the timing thereof with respect to the wrapping of an article remains constant and is assured.

17 Claims, 8 Drawing Figures

FIG.3
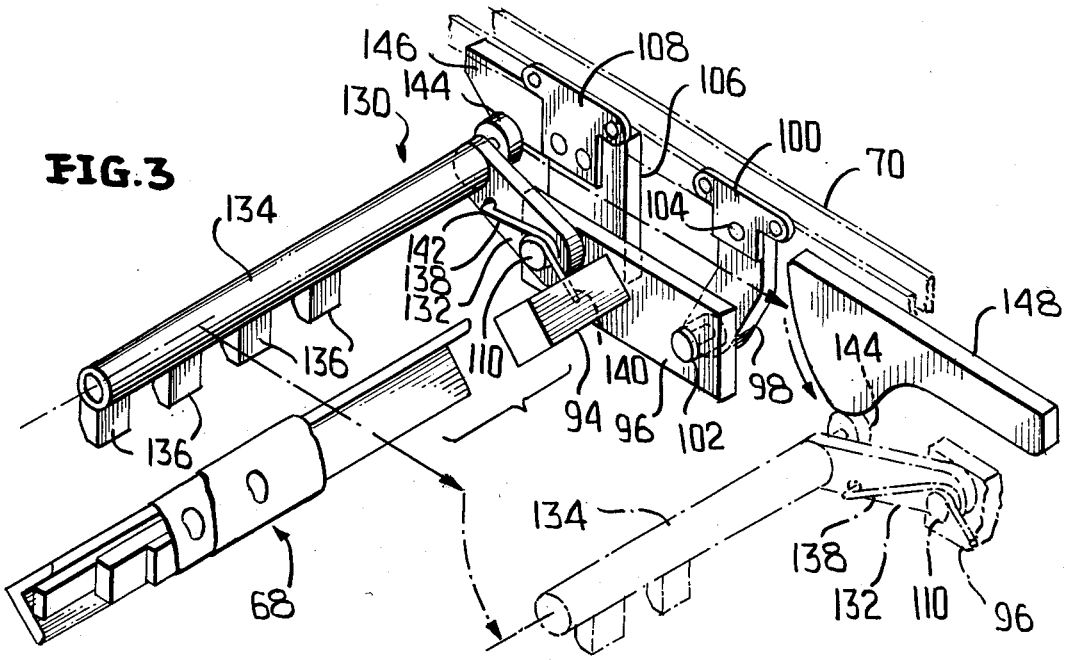
FIG.4
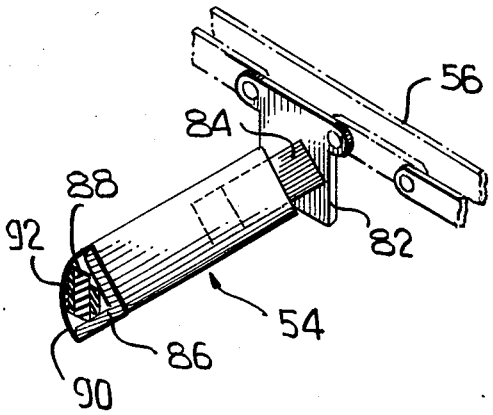
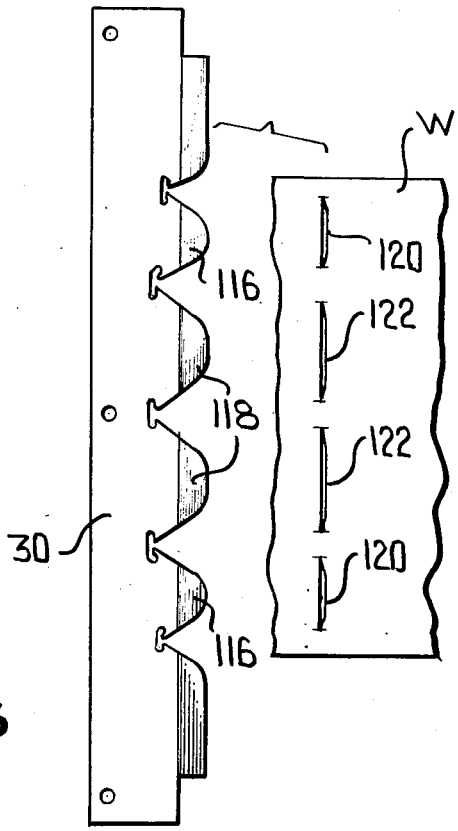
FIG.5

FIG. 6
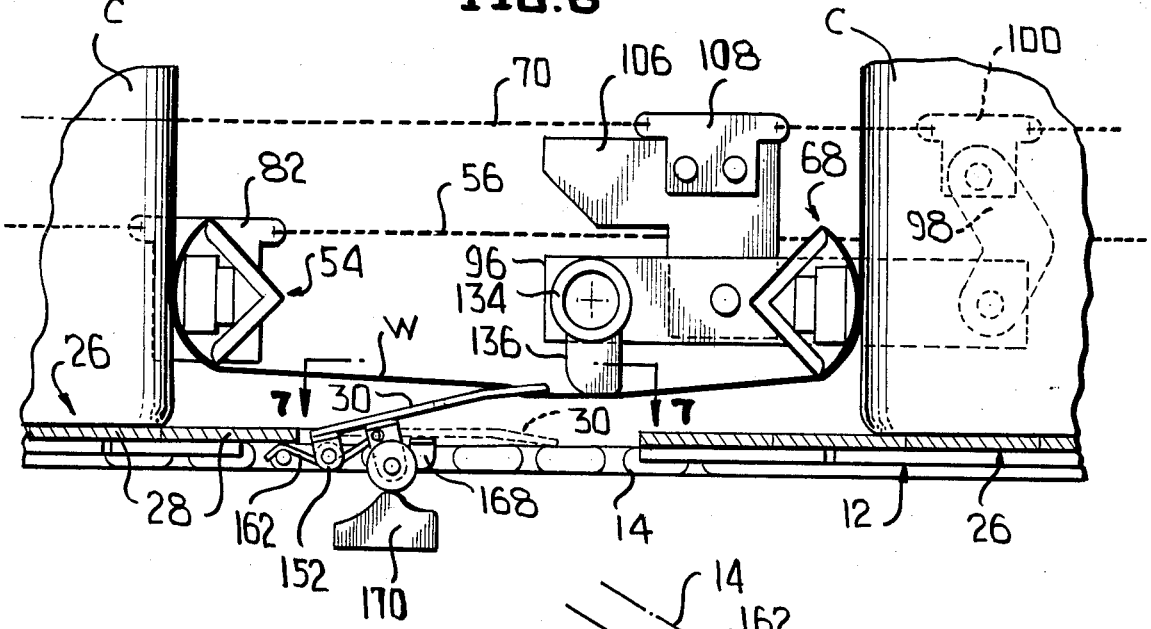
FIG. 8
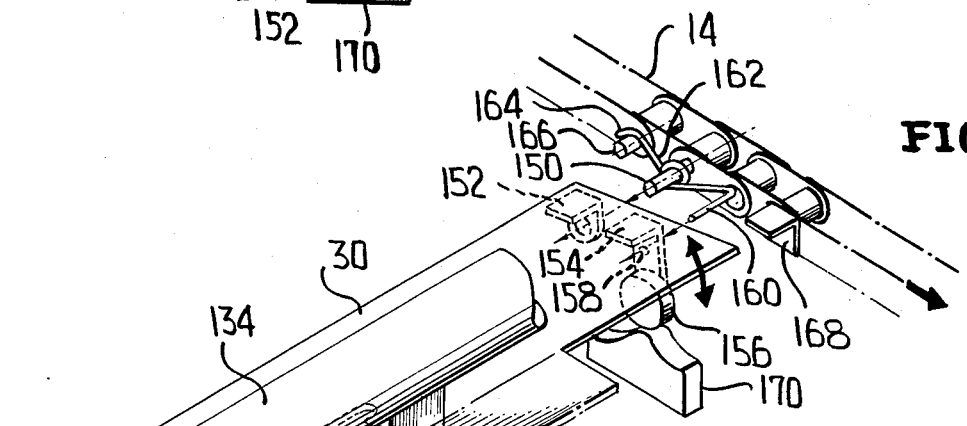
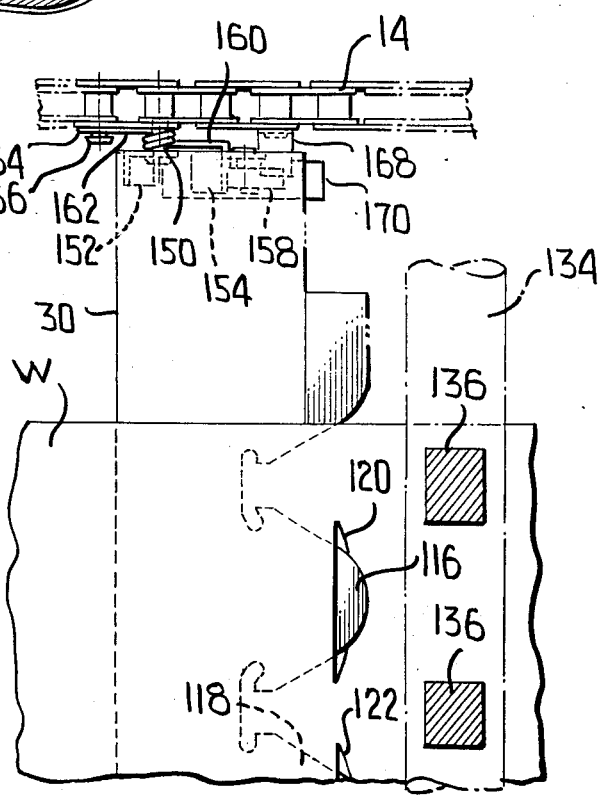
FIG. 7

WRAPPING MACHINE FOR APPLYING A WEB TO ONE OR MORE ARTICLES TO FORM A PACKAGE

This invention relates in general to new and useful improvements in wrapping machines, and more particularly to in such a wrapping machine novel web pressing means which effects the drawing of the required amount of a web and the hooking of such web onto a web drawing member which will eventually effect the separation of the web into individual web sections.

I previously developed a wrapping machine of the general type to which this invention relates but wherein a highly complex web pressing means was provided, which web pressing means was formed separate and apart from an article conveying mechanism and which required special timing with respect to the movements of articles being conveyed and wrapped.

In accordance with this invention, I have found that if I provide a very simple web pressing device which will hold the web between articles in position for receiving fingers of a web drawing member, these fingers will freely pass through openings formed in the web and effect a hooking of the web by the web drawing member in the necessary manner.

In one form of the invention, I simply provide a moving web pressing member which holds an intermediate portion of the web for engagement by the web drawing member and I tilt the web drawing member upwardly so as to have fingers thereof directed towards the opening in the web and as the web drawing member advances relative to the web, the fingers enter into the openings to hook the web onto the web drawing member.

In another form of the invention, I have provided web pressing means in the form of a simple lever supported bar which may be carried by an article positioning conveyor or a similar, but separate conveyor and which may be simply actuated by means of a simple cam which is fixedly positioned and wherein correct timing of the web pressing operation in conjunction with the movement of other components of the wrapping machine is assured.

With the above and other objects in view that will hereinafter appear, the nature of the invention will be more clearly understood by reference to the following detailed description, the appended claims and the several views illustrated in the accompanying drawings.

FIG. 3 is an enlarged fragmentary perspective view with parts broken away and shown in section of the web pressing means and means for clamping the web to the rear of an article being wrapped.

FIG. 4 is an enlarged fragmentary perspective view showing the details of an article restraining member which serves also to draw the web down in front of an article being wrapped.

FIG. 5 is an exploded schematic plan view showing the details of a web drawing member and an associated perforated web portion.

FIG. 6 is an enlarged fragmentary elevational view showing another form of means for effecting hooking of a web drawing member with the web.

FIG. 7 is an enlarged fragmentary plan view taken generally along the line 7—7 of FIG. 6 and shows further the details of the mechanism.

FIG. 8 is an enlarged fragmentary perspective view showing specifically the mounting of the web drawing member on its associated conveyor chain for pivotal movement including a cam mechanism for upwardly tilting the web drawing member to engage the web and spring means for returning it to its normal position.

Figure 1:
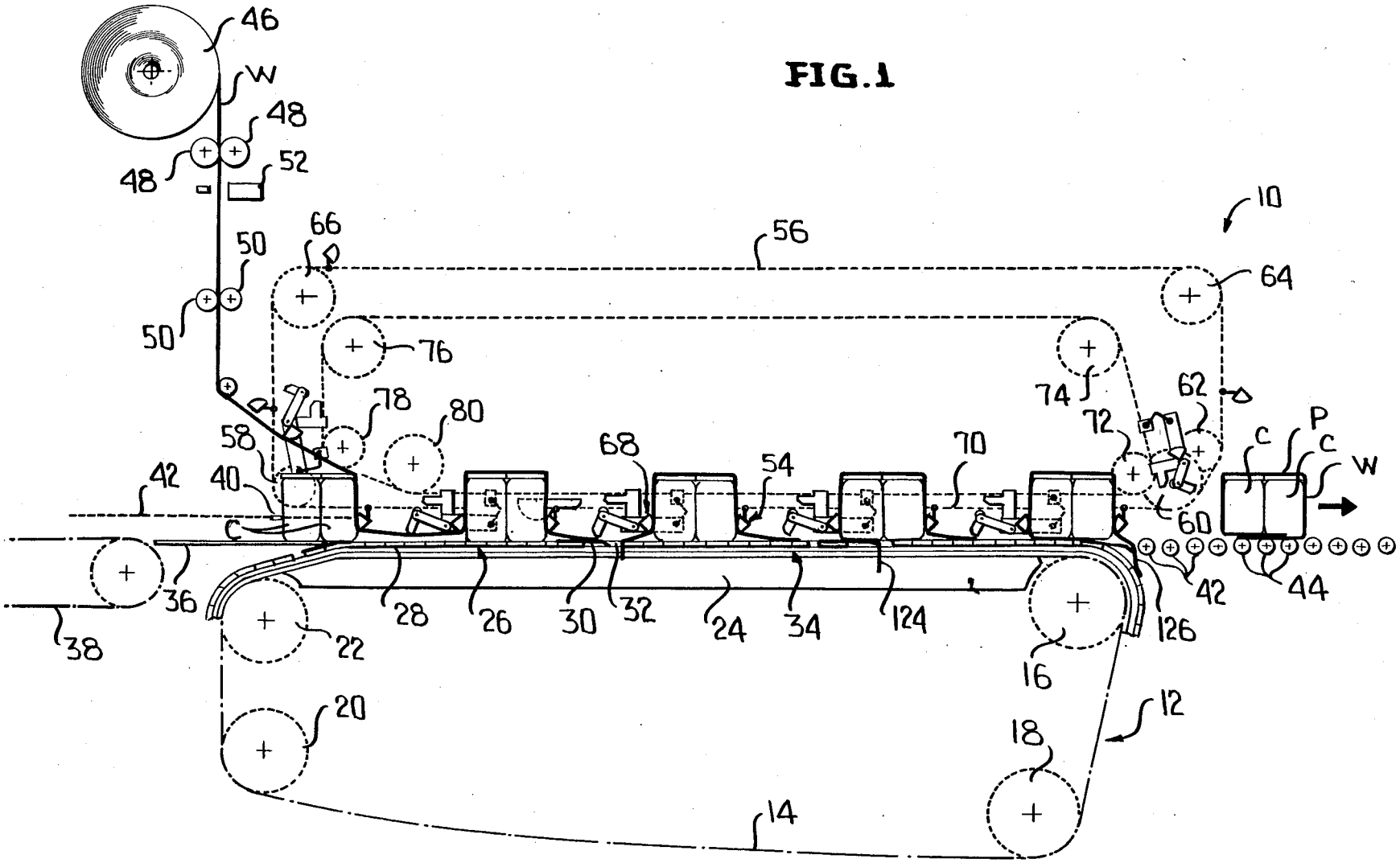
FIG. 1 is a side elevational view of a wrapping machine formed in accordance with this invention.

Referring now to the drawings in detail, it will be seen that there is illustrated in FIG. 1 a wrapping machine formed in accordance with this invention, the wrapping machine being generally identified by the numeral 10. The wrapping machine 10 is illustrated by wrapping cans arranged in two rows. It is to be understood that as far as this invention is concerned, the number of cans in a row is immaterial. Further, it is to be understood that although the wrapping machine has been illustrated as applying a web relative to cans arranged in two rows, the invention is not restricted to any particular type of article or any particular number of articles. For example, a single article may be wrapped utilizing the wrapping machine 10.

The wrapping machine 10 includes an article transporting conveyor generally identified by the numeral 12. The article transporting conveyor 12 includes a pair of endless chains 14 which are arranged in transversely spaced parallel vertical planes. Each of the chains 14 passes around a plurality of sprockets including sprockets 16, 18, 20 and 22. At least one of these sprockets is a drive spocket and the two drive sprockets, sprockets 16 for example, are interconnected for rotation in unison.

Between the sprockets 22 and 16 each conveyor chain 14 is supported by an elongated support bar 24 over which the respective conveyor chain 14 rides. The support bars 24 support the chains 14 so as to form a platform defining run.

The article transporting conveyor also includes groups of article supports generally identified by the numeral 26. Each group of article supports 26 includes a plurality of bars 28 which extend between and are connected to the two conveyor chains 14. At the forward end of each of the groups of article supports 26 is a web drawing member 30 which will be described in more detail. The last of the support bars 28 of an article supporting unit 26 will be spaced ahead of the leading edge of the respective web drawing member 30 so as to define an opening 32.

In advance of the platform defining run, which is generally identified by the numeral 34, is a dead plate 36. Articles or groups of articles are conveyed by a conveyor 38 onto the dead plate 36 and are then pushed across the dead plate 36 by means of pusher bars 40 of a further conveyor 42. The pusher bars 40 serve to push the article or group of articles onto the platform defining run 34.

At the trailing end of the platform defining run 34 there is a plurality of support rollers including idler rollers 42 and driven rollers 44. The driven rollers 44 will normally be driven at a linear speed greater than that of the platform defining run 34 so as to advance wrapped articles or packages away from the remainder of the wrapping machine 10.

At this time it is pointed out that a typical package formed by the wrapping machine 10 is identified by the letter P and will include cans C arranged in two rows and wrapped by a wrap W. Each row of cans C may include any number of cans, but generally either three cans to form a six-pack or four cans to form an eight-pack.

The wrap W is formed as a continuous web and is dispensed from a roll 46. The web W passes first between a pair of feed rolls 48 and then a pair of draw rolls 50. It is to be understood that the web W will be preprinted and alignment of the printing thereof with the article or articles being wrapped is desired. The web W is formed of a stretchable film and there is a sensing device 52 which controls the speed of operations of the draw rolls 50 so as to stretch or relax the web so as to maintain the required orientation.

The web W will be provided with a plurality of slits or openings as will be described hereinafter. These slits or openings may either be preformed in the web so as to appear in the roll 46 or there may be provided slitting means (not shown) for slitting the web as it passes into the wrapping machine 10.

It is to be understood that the articles to be wrapped travel along the platform defining run 34 at a speed lesser than that of the article transporting conveyor 12. In order to retard the movement of the articles (cans C), there is a series of retarder bars generally identified by the numeral 54. The retarder bars 54, which will be described in detail hereinafter, are carried by a pair of transversely spaced, parallel conveyor chains 56. The conveyor chains 56 each pass over a plurality of sprockets including sprockets 58, 60, 62, 64 and 66. One of these sprockets is driven in unison with the drive sprocket 16 for the article transporting conveyor 12. The drive sprocket may, for example, be the sprocket 60.

There is also a series of clamp bars 68 which become positioned behind each article or articles being wrapped and in conjunction with one of the retarder bars 54, serve to position the article or articles being wrapped on the faster moving platform defining run 34. The clamp bars 68 each extend between a pair of conveyor chains 70 which are in transversely spaced, parallel relation. Each conveyor chain 70 passes around a plurality of sprockets, including sprockets 72, 74, 76, 78 and 80. One of these sprockets for each conveyor chain 70 is driven. It may be, for example, the sprocket 72. The drive sprockets for the conveyor chains 56 and 70 are driven at the same linear rate so as to assure that control is maintained over the articles as the platform defining run 34 passes therebelow.

Referring now to FIG. 4, it will be seen that each retarder bar 54 is carried by a bracket 82 forming part of a link structure of the associated conveyor chain 56. Each bracket 82 has projecting therefrom a support pin 84 over which an end of the retarder bar 56 is telescoped.

The retarder bar 54 preferably is constructed of an angle member 86 which carries a resilient pad 88 and is telescoped within a resilient sleeve 90. The retarder bar 54 thus has a cushioned face 92 which serves to press the web W against the front face of the article or articles being wrapped.

Referring now to FIG. 3, it will be seen that each clamp bar 68 is of the same construction as the retarder bars 54 and has ends thereof telescoped over a pin 94 which projects from a bar 96. The bar 96 has a forward portion thereof mounted on a bracket 98 which depends from a link 100 of the conveyor chain 70 by way of a pivotal connection 102. The bracket 98 is also connected to the link 100 by a pivotal connection 104.

The rear end of the bar 96 is connected to a bracket 106 which in turn, is fixedly secured to a link 108 of the conveyor chain 70. There is a pivotal connection in the form of a pin 110 between the bar 96 and the bracket 106.

Figure 2:
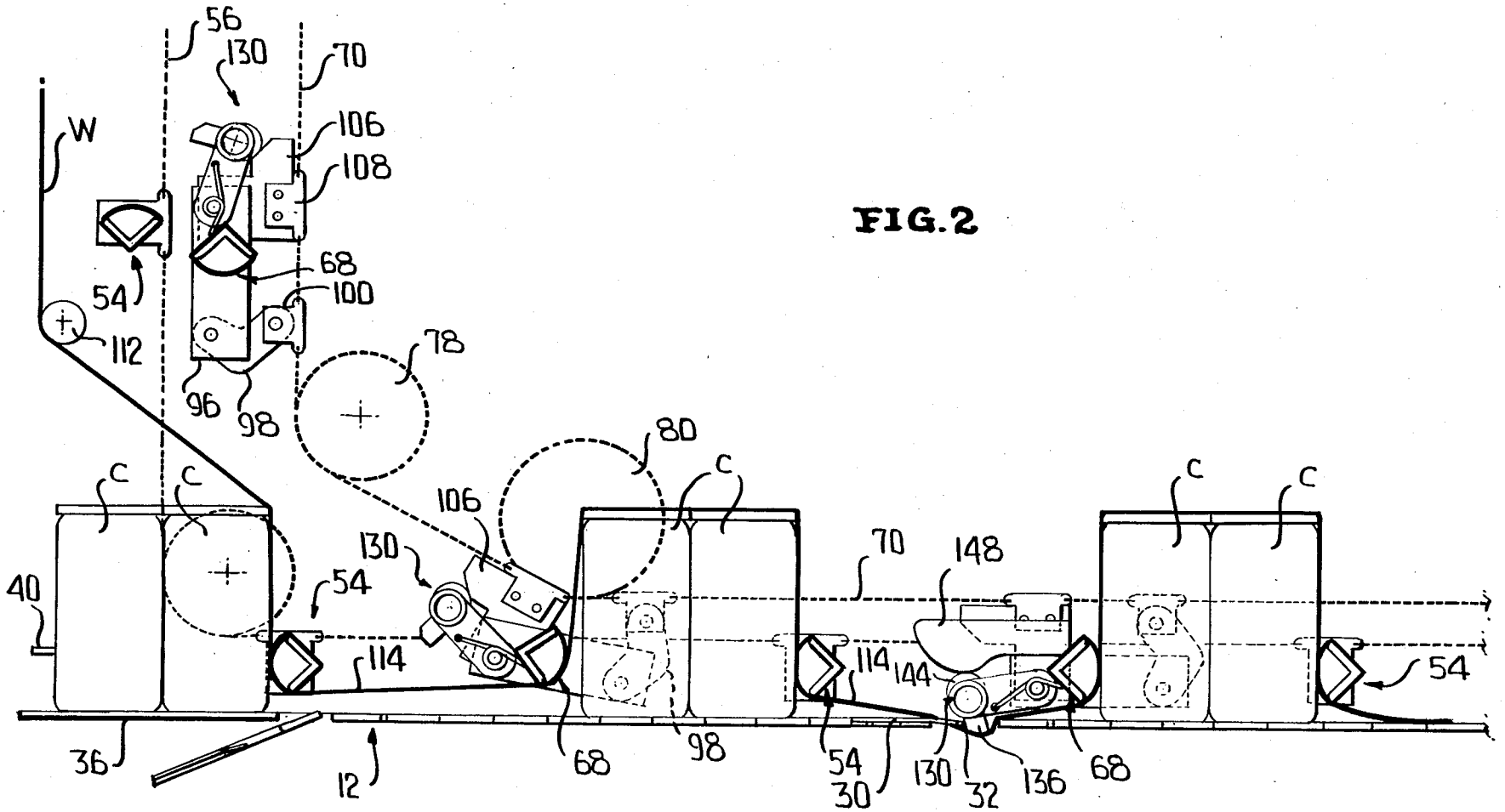
FIG. 2 is an enlarged fragmentary elevational view showing a portion of the wrapping machine with the web pressing means pressing the web into position for engagement by a web drawing member.

As will be apparent from FIG. 2, as that portion of the conveyor chain 70 carrying the brackets 98, 106 passes around the sprocket 80, the clamp bar 68 coupled thereto will swing down behind the article or articles being wrapped, drawing the web downwardly and clamping the web tightly against the rear of the article or articles. In the illustrated embodiment of the invention, the two rows of cans C will become clamped between a forward retarder bar 54 and a rear clamp bar 68. When so clamped, the cans C are then positioned for movement solely under the control of the bars 54, 68.

It is to be understood that the web W will pass down, around and under a control roll 112 and will be moved down in front of the next following group of cans C by a descending retarder bar 54. Thereafter the descending clamp bar 68 will engage the web and draw it down behind the group of cans being wrapped. As a result, there is a portion of the web W disposed between a clamp bar 68 and a next following retarder bar 54, the web portion being generally identified by the numeral 114.

When the relationship of the various components of the wrapping machine 10 are in the position illustrated in FIG. 2, it is desirable to press the web portion 114 down through a respective underlying opening 32 whereby the web drawing member 30 may become interlocked with the web W. At this time reference is made to FIG. 5 wherein it will be seen that the web drawing member 30 is provided with a plurality of forwardly projecting fingers 116 and 118 for reception within respective cutouts 120, 122 for interlocking with the web W and the eventual rupture of those portions of the web W transversely aligned with the cutouts 120, 122.

As will be readily apparent from FIG. 2, immediately after the draw member 30 is properly interlocked with the web in the manner described above with respect to FIG. 5, the following clamp bar 68 tightly clamps the web against the rear of the articles being wrapped. Further advancing movement of the draw member 30 relative to the articles being wrapped results in eventual tensioning of the web W and the rupture of the web portion transversely in alignment with the cutouts 120, 122.

Returning to FIG. 1, it will be seen that after the web has been separated into individual wrap members, due to the advancing of the article transporting conveyor 12 beneath the article being wrapped, a web trailing portion 124 is gradually drawn beneath the rows of cans C. Then, as the cans being wrapped pass off of the article transporting conveyor 12 onto the first set of rolls 42, a web leading edge portion 126 will be forced beneath the cans being wrapped and under the web trailing portion 124 to form a complete package.

Normally the web W will be in the form of a heat shrinkable film and the thus wrapped cans C and the package P formed of the cans C and the wrap or web W will pass into a conventional shrink tunnel (not shown) so as to heat and shrink the web about the cans.

The wrapping machine, as described, is the subject of a prior co-pending application of mine. The subject of this application particularly relates to a very simple and improved web pressing mechanism developed by me, the web pressing mechanism being generally identified by the numeral 130.

As is best illustrated in FIG. 3, the web pressing mechanism 130 includes a lever arm 132 carried by the pivot 110 of each of the bars 96. A bar or rod 134 extends between the free ends of the lever arms 132 and are supported thereby for movement. The bar 134 has depending therefrom at regular intervals pressing fingers 136.

The fingers 136 are normally retained in a retracted position by means of a spring 138 which is coiled around the pivot pin 110 and has one leg 140 thereof engaged with the pin 94 and the opposite leg 142 thereof engaged with the lever 132.

Each of the levers 132 carries a cam follower 144 and if desired, each cam follower 144 may have a projecting pin portion which engages behind an extension 146 of the bar 106 to limit the pivoting of the lever 132 in a clockwise direction as shown in FIG. 3.

Referring once again to FIG. 2, it will be seen that the wrapping machine 10 includes a fixed cam 148 positioned adjacent each of the conveyor chains 70 for engagement by a respective cam follower 144. As will be apparent from FIG. 2, when the articles being wrapped are in the position shown in FIG. 2, and the fingers 136 are aligned with one of the openings 32, the cam follower 144 engages its respective fixed cam 148 and momentarily moves the pressing fingers 136 down to press the web W down through the aligned opening 32. During this momentary depressing of the web through the opening 32, the web drawing member 30 immediately following the opening 32 and advancing relative to the web W will have the fingers 116, 118 thereof engaged in the cutouts 120, 122. At this time the cam follower 114 will ride off of the cam 148 and the spring 138 will then return the web pressing mechanism 130 to its retracted position.

The web pressing mechanism, having hooked the web on the web drawing member 30, as the web drawing member 30 continues to advance, the web will be tensioned and the web will automatically rupture transversely in alignment with the cutouts 120, 122 as previously described.

From the foregoing description and the drawings, it will be seen that the web pressing mechanism is of an extremely simple construction and that by properly positioning the cams 148, the timing of the pressing of the web into each opening 32 will be automatic. At this time it is pointed out that while no means have been illustrated for longitudinally adjusting the cam 148, any suitable adjusting means may be utilized. It is also pointed out here that while the web pressing mechanism 130 has been mounted on the pivot pin 110 of the linkage for supporting the clamp bar 68, other mounting means may be provided. Furthermore, it is feasible to provide a separate conveyor chain for carrying the web pressing mechanisms. Such separate conveyor chain would be driven at the same rate as the conveyor chains 56 and 70.

A further and perhaps more desirable means for engaging the web drawing member with the web is found in FIGS. 6, 7 and 8. In this form of the invention, in lieu of the web pressing mechanism 130 being mounted for pivotal movement, the lever arm 132 is omitted and the bar 96 is elongated. Then the rod or bar 134 is directly fixedly secured to the bar 96 as is shown in FIG. 6.

The bar or rod 134 has depending therefrom the fingers 136 which depend sufficiently below the normal path of the web W from the associated clamp bar 68 rearwardly to the associated retarder bar 54. Thus the web W slopes upwardly and rearwardly from the fingers 136.

In order that the forwardly directed fingers 116, 118 of the web drawing member 30 may enter into the slots 120, 122, the web drawing member 30 is mounted for pivotal movement and is caused to tilt upwardly and forwardly as shown in FIG. 6 to engage the web W.

With reference to FIG. 8, it will be seen that the conveyor chains 14 are provided with mounting pins 150 and the web drawing member 30 is provided on the underside thereof with a mounting bracket 152 for receiving the pin 150 and to thereby pivotally mount the web drawing member 30.

Preferably, there is another bracket 154 secured to the underside of the web drawing member 30 adjacent the bracket 152. The bracket 154 mounts a cam follower 156 whose function will be described hereinafter. The bracket 154 also has a hole 158 therethrough through which there passes one leg 160 of a spring 162 which is mounted on the pin 150. The spring 162 has a second leg 164 which bears against another pin 166 carried by the associated chain 14. It will be seen that the spring 162 always urges the web drawing member 30 in a clockwise direction with the web drawing member being seated on a further bracket 168 also carried by the conveyor chain 14 so as to retain the web drawing member 30 in a generally planar state with the remainder of the article supporting unit 26 of which the web drawing member 30 is a part.

The machine further includes a fixed cam 170 which is disposed in the path of the cam follower 156 so that as the fingers 116, 118 of the web drawing member 30 approach the fingers 136 of the web pressing assembly 130, the web drawing member 30 will be tilted upwardly from its generally horizontal position to its upwardly and forwardly tilted position shown in solid lines in FIG. 6. The fingers 116, 118 engage the web W slightly rearwardly of the openings 120, 122.

Inasmuch as the web drawing member 30 is moving faster than the web W, it will be seen that the fingers 116, 118 will have their tips slide along the underside of the web a short distance before they enter into the openings 120, 122.

While the fingers 136 are located on opposite sides of the fingers 116, 118, and the tips of the fingers 116, 118 may pass between adjacent fingers 136, it will be seen that after the fingers 116, 118 have been partially engaged within the openings 120, 122, the cam follower 156 will begin to ride down off the cam 170 and further relative movement of the web drawing member 30 relative to the web W will result in the web being snapped along the line of the openings 120, 122 so as to separate the web into individual web portions for the individual packages being formed.

It is believed that the simplicity of the interlocking of the web drawing member with the web as well as the assured interlocking, will be appreciated.

While no means has been illustrated for driving the various conveyor chains in unison, it is to be understood that preferably there will be a single drive motor which will be intercoupled with the drive sprockets of the various conveyor chains.

Although only a preferred embodiment of the wrapping machine has been specifically illustrated and described herein, it is to be understood that minor variations may be made in the wrapping machine without departing from the spirit and scope of the invention as defined by the appended claims.

I claim:

1. A wrapping machine for applying a web to an article to form a package, said wrapping machine comprising a web supply, an article transporting conveyor having a platform defining run, said article transporting conveyor including series of support members separated by openings, each of said series of support members having a multi-fingered web drawing member immediately trailing a respective one of said openings, article positioning means for movement generally along said platform defining run at a lesser rate than said article transporting conveyor, and pressing means movable with said article positioning means for pressing a portion of the web located between two adjacent ones of said article positioning means into the path of one of said web drawing members to hook the web on said one said web drawing member.

2. A wrapping machine according to claim 1 wherein said pressing means includes a supporting conveyor having a run disposed generally parallel to said platform defining run, a plurality of web pressing members pivotally mounted on said supporting conveyor, and cam means for pivoting each web pressing member towards said platform defining run in sequence.

3. A wrapping machine according to claim 2 wherein each of said web pressing members includes a bar having spaced therealong a plurality of depending fingers, said fingers being aligned between adjacent fingers of an associated one of said web drawing members.

4. A wrapping machine according to claim 2 wherein parts of said article positioning means are carried by said supporting conveyor.

5. A wrapping machine according to claim 2 wherein said article positioning means includes a plurality of clamp bars for clamping the web against backs of articles being wrapped, and said clamp bars being carried by said positioning conveyor.

6. A wrapping machine according to claim 1 wherein said article transporting conveyor moves at a first linear rate and said article positioning means and said pressing means move at a second and slower linear rate whereby said article transporting conveyor moves a trailing part of a separated web portion beneath an article being wrapped.

7. A wrapping machine according to claim 6 wherein said article positioning means include retarder bars for engagement by articles to restrain such articles for movement at said second linear rate by said article transporting conveyor along said platform defining run.

8. A wrapping machine according to claim 2 wherein except when pivoted by said cam means, said web pressing members when moving along said platform defining run move generally parallel to said platform defining run.

9. A wrapping machine according to claim 1 wherein said pressing means includes a supporting conveyor having a run disposed generally parallel to said platform defining run, a plurality of web pressing members mounted on said support conveyor, and each of said web pressing members includes a bar having spaced therealong a plurality of depending fingers, said fingers being aligned between adjacent fingers of an associated one of said web drawing members.

10. A wrapping machine according to claim 9 wherein parts of said article positioning means are carried by said supporting conveyor.

11. A wrapping machine according to claim 1 wherein said pressing means includes a supporting conveyor having a run disposed generally parallel to said platform defining run, a plurality of web pressing members mounted on said supporting conveyor, each of said web drawing members being pivotally mounted relative to an adjacent one of said support members for movement towards said pressing means to effect said hooking of the web on a respective web drawing member.

12. A wrapping machine according to claim 11 wherein there are cam means for effecting said pivoting of each of said web drawing members at a time such web drawing member is approaching said pressing means.

13. A wrapping machine according to claim 12 wherein said pressing means includes a supporting conveyor having a run disposed generally parallel to said platform defining run, a plurality of web pressing members mounted on said support conveyor, and each of said web pressing members includes a bar having spaced therealong a plurality of depending fingers, said fingers being aligned between adjacent fingers of an associated one of said web drawing members.

14. A wrapping machine according to claim 11 wherein there are means urging each of said web drawing members to a planar state relative to the respective adjacent support member, and cam means for effecting said pivoting of each of said web drawing members at a time such web drawing member is approaching said pressing means.

15. A method of wrapping an article with a web, said method comprising the steps of providing an article transporting conveyor having a platform defining run, said article transporting conveyor being provided wtih transverse openings therethrough at regularly spaced intervals and there being a multi-fingered web drawing member projecting forwardly into each of said openings from the rear, positioning articles to be wrapped onto said platform defining run, providing a web supply, providing article positioning means in overlying relation to said platform defining run with said article positioning means moving down across a path of said web to draw a web portion over and down between articles being wrapped and thereafter retarding movement of articles along said platform defining run by said article transporting conveyor, moving web pressing means with said article positioning means in overlying adjacent relation to web portions between adjacent articles, and then relatively moving one of said web pressing means and an associated one of said web drawing members together to have an associated one of said web portions located in the path of the associated one of said web drawing members to effect hooking of said associated web drawing member with an associated web portion.

16. A method according to claim 15 wherein said web drawing members normally move generally parallel to said platform defining run and are cam actuated to move said associated web drawing member into the path of the associated web portion.

17. A method according to claim 15 wherein said web pressing means are pivotally mounted and are cam actuated towards the platform defining run to present an associated web portion in the path of an associated web drawing member.

* * * * *